United States Patent [19]

Bagley et al.

[11] Patent Number: 4,871,621

[45] Date of Patent: Oct. 3, 1989

[54] METHOD OF ENCASING A STRUCTURE IN METAL

[75] Inventors: Rodney D. Bagley, Big Flats; Raja R. Wusirika, Painted Post, both of N.Y.

[73] Assignee: Corning Incorporated, Corning, N.Y.

[21] Appl. No.: 133,303

[22] Filed: Dec. 16, 1987

[51] Int. Cl.[4] ..... B22F 7/00

[52] U.S. Cl. ..... 428/549; 264/57; 264/60; 419/5; 419/9; 419/10; 419/23; 419/24; 419/36; 419/37; 428/37; 428/469; 428/548; 428/552; 428/553; 428/560; 428/562; 428/565; 428/688

[58] Field of Search ..... 419/5, 9, 10, 23, 24, 419/36, 37; 428/549, 548, 552, 553, 560, 562, 565, 469, 688, 37; 264/57, 60

[56] References Cited

U.S. PATENT DOCUMENTS

| | | | |
|---|---|---|---|
| 2,966,719 | 1/1961 | Park, Jr. | 25/156 |
| 3,007,222 | 11/1961 | Ragan | 25/156 |
| 3,112,184 | 11/1963 | Hollenbach | 25/156 |
| 3,444,925 | 5/1969 | Johnson | 165/166 |
| 3,790,654 | 2/1974 | Bagley | 264/177 |
| 3,794,707 | 2/1974 | O'Neill et al. | 264/56 |
| 3,824,196 | 7/1974 | Benbow et al. | 252/455 R |
| 3,864,124 | 2/1975 | Breton et al. | 75/212 |
| 3,885,977 | 5/1975 | Lachman et al. | 106/62 |
| 3,919,384 | 11/1975 | Cantaloupe et al. | 264/177 R |
| 3,963,504 | 6/1976 | Lundsager | 106/41 |
| 4,017,347 | 4/1977 | Cleveland | 156/89 |
| 4,194,040 | 3/1980 | Breton et al. | 75/211 |
| 4,582,677 | 4/1986 | Sugino et al. | 419/2 |
| 4,649,003 | 3/1987 | Hashimoto et al. | 264/63 |
| 4,673,658 | 6/1987 | Gadkaree et al. | 501/89 |

OTHER PUBLICATIONS

Thompson, J. J., "Forming Thin Ceramics," *Ceramic Bulletin*, vol. 42, No. 9, pp. 480–481 (1963).

*Primary Examiner*—Stephen J. Lechert, Jr.
*Attorney, Agent, or Firm*—Dianne B. Elderkin; Norman L. Norris; Richard N. Wardell

[57] ABSTRACT

An improved method for encasing objects in metal is disclosed as are the novel encased objects so prepared. An object is wrapped with a sheet comprising sinterable particulate or powdered metal and an organic binder, and is the fired to volatilize the binder and to sinter the particulate metal into a unitary metal structure. In the preferred embodiment of this invention, the object to be encased is a green sinterable particulate object which undergoes sintering simultaneously with the particulate metal casing during the firing step.

42 Claims, No Drawings

METHOD OF ENCASING A STRUCTURE IN METAL

BACKGROUND OF THE INVENTION

This invention relates to metal-encased objects, especially ceramic and metal objects. This invention further relates to the method for preparing such metal-encased objects.

Because of their high resistance to heat and oxidation, ceramic materials are used to manufacture a wide variety of industrial parts. Often, it is necessary or desirable to encase the ceramic part in metal so that it may be welded to other metal parts. For example, the catalytic converters used in automobiles comprise a ceramic honeycomb structure, coated with catalyst, which structure is then encased in a metal can so that it may be welded to the automobile chassis. The process presently used for encasing the catalytic converters in metal is costly and labor intensive. A piece of metal cut in a clam-shell shape is bent around the previously coated and fired ceramic substrate, held in that position and welded closed. Even if the metal casing is tightly fit around the converter at room temperature, the metal will expand differentially from the ceramic at higher temperatures, causing the ceramic to metal fit to loosen, allowing the converter to move within the casing during use and become damaged.

There is, therefore, a clear need for metal encased articles which can be prepared by a less costly and labor intensive method than that currently used and which will not possess the above-mentioned disadvantages arising from the differential expansion of the ceramic and the metal.

SUMMARY OF THE INVENTION

Improved metal encased objects have been made where said metal casing comprises a sheet of sinterable particulate or powdered metal admixed with an organic binder which sheet has been wrapped around the object and then fired to volatilize the binder and to sinter the metal particles or powder into a unitary metal structure. Preferably, the object to be so encased is a green, sinterable object and undergoes sintering simultaneously with the particulate or powdered metal sheet; however, the object may also be a pre-fired (sintered) article. This invention therefore relates to such metal encased objects in their intermediate form, i.e., encased in the green wrapped sheet, as well as in their final, sintered form.

In a preferred embodiment, the objects which are encased according to this invention comprise a honeycomb body or multichannel monolith having substantially parallel cells or passages extending between open end faces thereof. In another embodiment of this invention, a layer of flexible compressible material is interposed between the object and the sheet of sinterable particulate or powdered metal.

This invention relates not only to the aforementioned articles but also to the method of preparing them. Thus, this invention also relates to a method for encasing an object in metal comprising wrapping said object with a sheet comprising sinterable particulate or powdered metal admixed with an organic binder, and firing the wrapped object to volatilize the binder and to sinter the particulate or powdered metal into a unitary metal structure.

It is an object of this invention to provide a metal encased object which can be prepared by a low cost and low labor-intensive process. It is another object of this invention to provide a metal encased object where the object is of an inorganic material. It is a further object of this invention to provide a metal encased object which will not be subject to damage because of the differential thermal expansions of the metal casing and the encased article. It is also an object of this invention to provide an article wherein a ceramic or metal structure is married to a sinterable metal powder whereby both materials are fired to a hardened structure in one step.

DETAILED DESCRIPTION OF THE INVENTION

The object to be encased in metal according to the method of this invention may be any object capable of withstanding the high temperatures to which it will be exposed during the firing step. Generally, the object will be a glass, glass-ceramic, ceramic, cermet or metal object or an object of a composite of any such material such as a matrix containing fibers and/or whiskers of a same or different material. Such structures may be formed from sinterable particles or powders which may be intermixed with fibers and/or whiskers for forming a composite and may be sintered prior to being used in the method of this invention; however, an advantage of this invention is that these structures may be utilized in their green preform states and sintered simultaneously with the sintering of the particulate metal sheet or preform during the firing step. The term "green" is used in the art and in this application to refer to the state of a formed body or piece made of sinterable powder or particulate material that has not yet been fired to the sintered state. The green body may have been heated to dry it by evaporating or volatilizing plasticizing liquid or vehicle and perhaps also to burn out or volatilize organic or decomposable binders mixed with the sinterable powder to render it adequately plastically formable and/or sufficiently coherent (having green strength) so that the body can be handled without deformation and other damage. Thus, for example, to prepare a ceramic honeycomb monolith or ceramic monolithic catalyst encased in metal according to a preferred embodiment of this invention, a monolith comprising a mixture of metal oxide powders, catalyst and plasticizing binder may be encased in a sheet of sinterable particulate metal and binder material. Upon firing, the metal oxide powders sinter to form a ceramic structure, and the outer layer of sinterable particulate metal simultaneously fires to form a metal casing.

The conventional ceramic monolithic catalyst consists of a ceramic support with a coating of high surface area material upon which the catalyst is actually deposited. To provide maximum surface area, it is preferred that the monolith be a thin-walled cellular or honeycomb structure. The preferred method for forming the honeycomb or multipassage monolith is by extrusion as disclosed in U.S. Pat. Nos. 3,790,654 and 3,824,196. Other methods are known, however, including the methods disclosed in U.S. Pat. Nos. 3,112,184, 3,444,925 and 3,963,504.

A wide variety of sinterable particulate materials are known which may be used to prepare the objects which are encased in metal according to this invention and, specifically, to prepare a monolith catalyst support. Reference to such suitable materials is made in U.S. Pat. Nos. 3,112,184, 3,444,925, 3,824,196, 3,885,977, 3,919,384, 3,963,504, 4,017,347, and 4,582,677, the disclosures of which are herein incorporated by reference. Examples of suitable particulate materials include glasses, such as boro-silicates, soda-lime-silicates, lead-silicates, alumino-silicates, and alkaline earth silicates, and refractory compositions (ceramics), such as alumina, sillimanite, silicon nitrides, silicon carbides, mullite, fused silica, cordierite, magnesia, zircon, zirconia, petalite, spodumene, corundum, fosterite, barium titanate, porcelain, thoria, urania, steatite, samaria, gadolinia, various carbides including boron carbide, and spinels.

Objects may also be formed from glass-ceramics or from sinterable ceramic and metal mixtures, e.g., chromium and alumina mixtures, to form cermets. Also suitable are objects formed from sinterable metal powders, e.g., powders of Fe, Al, Cu, Ti, Zr, Ni, Cr and various other alloys. Additional examples of metal powders which can be sintered to form a sintered body are disclosed in U.S. Pat. No. 4,649,003, the disclosure of which is herein incorporated by reference. U.S. Ser. No. 054,845, filed May 27, 1987, the as-filed disclosure of which is hereby incorporated by reference, discloses aluminum-iron substrates suitable for use herein. The substrates disclosed in U.S. Ser. No. 054,845 are porous metal bodies which are prepared by sintering homogeneous mixtures of particulate Al, Fe and Mg and/or Ca with, optionally, Sn, Cu and/or Cr. More specifically, the Al/Fe bodies disclosed in U.S. Ser. No. 054,845 consist essentially, in weight percent, of 5–50% Al, 30–90% Fe, the sum of Al and Fe constituting at least 80% of the total composition, 0–10% Sn, 0–10% Cu, 0–10% Cr, the sum of Sn and Cu and Cr being less than 20%, and not more than 1% of an alkaline earth metal selected from the group consisting of Mg and Ca.

In one preferred embodiment of this invention, the object to be encased is a metal object such as the above-mentioned Fe/Al object. It is believed that, upon sintering, metal-metal bonds may be created between the underlying metal object and the metal casing. Additionally, the metal casing may have lesser or greater porosity than the encased object as suits a particular need.

The objects may optionally contain reinforcing whiskers, e.g., of alumina, silicon nitride or silicon carbide, or fibers, e.g., carbon fibers, as disclosed in U.S. Pat. Nos. 3,794,707 and 4,673,658. This invention is not dependent upon the selection of the material of which the object to be encased is comprised, and the above-mentioned materials are recited solely for purposes of exemplification.

The sheet of sinterable particulate metal and binder material which is used in the process of this invention may be made in a number of ways. Methods analogous to known methods for preparing thin sheets of sinterable ceramic particles, such as tape casting and extrusion, are especially suitable. See, for example, Thompson, J. J., "Forming Thin Ceramics," Ceramic Bulletin, Vol. 42, No. 9, page 480 (1963); U.S. Pat. No. 2,966,719 to J. L. Park, Jr.; U.S. Pat. No. 3,007,222 to Ragan; and U.S. Pat. No. 3,444,925 to Johnson, the disclosures of which are hereby incorporated by reference.

To form a sheet by tape casting, a slurry of metal particles and an organic binder in a suitable volatile solvent is made. The slurry may also contain wetting agents and plasticizers. Organic binders ideally form a tough, flexible film with less than about 10% binder, volatilize to a harmless, nonpoisonous gas leaving no residual gas during the firing of the wrapped article, and are soluble in inexpensive, volatile, nonflammable solvents. Suitable binders include but are not limited to methyl cellulose, polyvinyl butyral, and various acrylic polymers. Suitable solvents include but are not limited to methylethyl ketone, toluene, methylene chloride, trichloroethane, and mixtures thereof or water. The slurry will generally comprise about 60 to 85 weight % solids, with best results being achieved using a slurry having about 80 weight % solids. Slurries having less than about 60 weight % solids are too plastic or soft, while slurries having greater than about 85 weight % solids tend to crack when being handled.

After the slurry has been ball milled long enough to form a homogeneous mix and deaired, it is coated with a doctor blade onto a carrier tape. The carrier tape is a flexible, nonporous material which is insoluble in any of the constituents in the slurry. Materials such as nylon and polyester films, preferably coated on one side with silicone to aid in removal of the tape cast material when dry, can be used. The slurry-coated tape can be air dried at room temperature or passed through a heated, forced air dryer. When dry, the sheet of metallic particles/-binder can be pulled off the carrier film and used in the process of this invention.

To form a sheet of particulate metal and binder by extrusion, a water soluble polymeric organic binder, such as methyl cellulose, is generally used. The binder and, optionally, plasticizer and/or wetting agent, are combined with the metal powder in water to form a dough. The moisture content of the dough is adjusted to form a heavy paste which is deaired and extruded at a moderate pressure through a die to form a continuous strip or tape. The tape is then dried to further reduce the moisture content.

The particulate or powdered metal used in this invention can be any metal available in powders or particles capable of being sintered to form a unitary metal structure. Examples of such metals include iron, aluminum, and copper as well as mixtures or alloys of any of such metals and all of the metals disclosed above in connection with the description of metal objects to be encased according to this invention. The preferred metals are those which will provide a weldable metal casing that is ductile and corrosion resistant. For this reason, stainless steel powders, especially the 300 and 400 series stainless steel powders, are the preferred metals. The particulate metals may optionally have any inorganic reinforcing fibers and/or whiskers incorporated therein. For reasons of safety and ease of processing, the particulate or powdered metal preferably has a particle size within the range of about 5 to 100 microns.

The tape of sinterable particulate metal and binder prepared by tape casting or extrusion may be used directly to wrap the object to be encased with metal, or, if a thicker metal casing is desired, several layers of the tape material may be heat-pressed to produce a sheet of the desired thickness.

After wrapping the sheet of sinterable particulate metal and binder around the object to be encased, a strong seam can be formed by joining the ends of the sheet material and sealing them to one another by applying to the seam a portion of the particulate metal/-binder slurry used to prepare the sheet material.

The particulate metal sheet undergoes considerable shrinkage when it sinters during the firing step. The underlying object may not sinter as much and may therefore not shrink to the same degree as the metal sheet wrap. To avoid breakage, it is desirable to carefully control the shrinkage differential between the metal sheet wrap and the underlying object by, for example, controlling the tightness of the wrap around the object prior to sintering. Another option is to interpose between the underlying object and the metal sheet wrap a flexible compressible material capable of absorbing the stresses involved during shrinkage of the metal sheet wrap. Such flexible materials could include compressible metal fiber and ceramic fiber meshes and/or mats such as steel wool, or a mat of zirconia or mullite.

The metal sheet-wrapped assembly is fired in a nonoxidizing gas under conditions suitable to sinter the metal particles in the wrap into a unitary metal structure and, if the underlying object is a green ceramic, to convert it to a fired ceramic object. Suitable nonoxidizing gases include argon and forming gases such as mixtures of nitrogen and hydrogen. Generally, sintering temperatures are within the range of about 1000° C. to 1300° C., and preferably, in forming gas, are within the range of about 1150° C. to 1250° C. Excellent results were also obtained by firing at 1300° C. in hydrogen gas.

Since an organic binder is incorporated in the green metal casing, it is possible that the sintered metal casing will be porous. It is preferred that the porosity of the sintered metal be in the range of 0 to 20% and more preferred that the porosity be substantially 0%; however, tests indicate that metal casings with porosities as high as 40% are acceptable.

The articles and methods of this invention are further illustrated in the following examples which are intended to be illustrative, but not limiting, of this invention.

EXAMPLE 1 a. Slurry Preparation

A 60/40 wt % (solids/organics) slurry of reduced iron powder (J. T. Baker Chem. Co.) was prepared. This was accomplished by placing 100 $Al_2O_3$ balls in a Nalgene jar (500 ml) and adding 133.3 grams vinyl butyrol system (a mixture of vinyl butyrol in toluene and methylene chloride; Type 73210, TAM Ceramics, San Marcos, Calif.). Subsequently, 8.4 g of a surfactant (a phosphate ester of alcohol ethyoxylate, Emphos PS-21A, Witco Chemical Corp., New York, N.Y.) was added, representing 2.51% of the total weight. 200 grams of iron reduced powder was weighed out into the Nalgene jar. This organic-metal mixture was shaken vigorously for one to two minutes. After sealing the lid tightly, the slurry was shaken vigorously for one to two minutes, to insure that the metal was totally covered by organic vehicle, before placing it on a variable speed roller mill.

After milling for twenty-four hours at a speed of 32 rev/min, the $Al_2O_3$ balls were removed by filtration. A glass funnel was placed on a ring stand with a small piece of stainless steel wire mesh to block the neck. The jar was poured into the funnel and stirred with a spatula (stainless steel) to release as much of the slurry as possible from the balls. This was done quickly and with a cover to minimize the rate of vaporization.

The filtered slurry was returned to the roller mill at the previous speed to assist in deaeration of the slip. Rolling was continued for another twenty-four hours.

b. Tape Casting

Tape casting of the metal film was accomplished using a Model 164 Tam Casting Table (TAM Ceramics). A strip of carrier film (a 2 mil film, having a polyester base with a silicone coating on one side; available from Custom Coating and Laminating of Worcester, Mass.) was placed on top of the cleaned glass plates with the silicone-coated side facing up. The film was smoothed out carefully to remove any air pockets.

The hydraulic push arm was then moved to roughly two inches in from the edge of the film on the glass. To set the doctor blade against the pushbar for alignment, the blade was positioned and the hydraulic bar moved back in the opposite direction of the cast to be made (roughly one inch). This prevented jerking with the introduction of surface irregularities at the onset of the cast.

Enough of the metal slurry from the roller mill was then poured in a smooth, steady manner to make a six foot strip of tape. A small quantity of slurry was poured in front of the blade edge to form a roll edge where the doctor blade could perform properly. The slip was poured steadily about 1 to 2 inches in front of the blade center as it was moving along the carrier film. This allowed the slurry to be dispersed evenly over the width of the blade being used and minimized the defects produced when pouring back and forth in front of the blade edge. The tape cast sheet was left on the carrier film overnight to dry.

c. Tape Blanking and Pressing

The metal powder sheet was pulled off of the carrier film and cut into squares. A stainless steel plate was covered with a sheet of Tedlar film (Curbull Industrial Plastics, Rochester, N.Y.), followed by six layers, each 10 ml thick, of the metal powder tape cast sheet. The corners were squared up so ragged edges did not entrap air while pressing. Another sheet of Tedlar film was placed on top of the stacked sheets followed by a second stainless steel plate. The "sandwich" of metal plates, Tedlar and tape cast material was placed in a warming oven at 75° C. for fifteen minutes. After preheating, the sandwich was placed on a Carver Press with heating plates. The press temperature was 75° C. The sandwich was then pressed to 3000 psi and held for five seconds; then 6000 psi, held five seconds; 9000 psi, held five seconds; 12,000 psi, held five seconds, and, finally, 25,000 psi, held fifteen seconds. The pressure was then gradually released, the sandwich was removed, the plates and Tedlar film were taken off and the tape cast piece was completely laminated.

d. Encapsulation

A green cordierite ($2MgO\ 2Al_2O_3\ 5SiO_2$) ceramic monolith was encapsulated. First a layer of steel wool was placed around the green ceramic monolith. Then the pressed multilayer stack of tape cast sheet was wrapped around the steel wool. The ends of the sheet were sealed together by applying to the seam a diluted slurry of the composition used to tape cast the metal sheet. After drying, the process was repeated until a good seal was made. Once the encapsulated piece was dry, it was fired (in argon at 150° C. per hour to 1200° C., two hour hold, cooled at furnace rate) to achieve the final canister form.

EXAMPLE 2

A sheet was tape cast using the procedure of Example 1 and a slurry of 100 grams metal powder in 42.8 grams of the following mixture: 42.4 grams acrylic polymer binder (MLC Binder E. I. du Pont de Nemours and Company, Wilmington, Del.), 10 grams plasticizer (Monsanto Santicizer 160, Monsanto Co., St. Louis, Mo), 54.5 grams 1,1,1 trichloroethane. The resulting slurry had 70 weight % solids. A green cordierite (as in Example 1) ceramic monolith was encapsulated, and the piece dried and fired as described in Example 2.

EXAMPLE 3

A sheet was tape cast using the procedure of Example 1 and a slurry of 100 grams stainless steel powder (316L) in the binder/plasticizer/trichloroethane mixture of Example 2. The slurry had 70 weight % solids.

The tape was wrapped around an already fired extruded metal (14% Fe, 86% Al alloy) honeycomb monolith, and the wrapped object was fired to 1300° C. in argon for four hours.

What is claimed is:

1. An article comprising an object encased in metal where said metal casing comprises a sheet of sinterable particulate or powdered metal admixed with a binder which sheet has been (a) wrapped around said article (b) has been subsequently fired into a unitary metal structure.

2. The article of claim 1 where said object is formed from a sinterable particulate material.

3. The article of claim 2 where said sinterable particulate material is selected from the group consisting of glasses, ceramics, glass-ceramics, cermets and metal powders.

4. The article of claim 2 where said object is in a green form prior to the firing of said sheet of sinterable particulate or powdered metal admixed with organic binder.

5. The article of claim 2 where said object is sintered prior to the firing of said sheet of sinterable particulate or powdered metal admixed with organic binder.

6. The article of claim 3 where said object is a ceramic monolithic substrate.

7. The article of claim 6 where said ceramic monolithic substrate is in the green form prior to the firing of said sheet of sinterable particulate or powdered metal admixed with organic binder.

8. The article of claim 1 where said object is a honeycomb monolith.

9. The article of claim 8 where said object is a metal or ceramic honeycomb monolith.

10. The article of claim 1 where said sheet of sinterable particulate metal is a tape cast sheet.

11. The article of claim 10 where said sheet is tape cast from a slurry of particulate metal, binder and volatile organic solvent comprising about 60 to 80 % by weight solids.

12. The article of claim 1 where said sheet of sinterable particulate metal is an extruded sheet.

13. The article of claim 1 where said particulate metal is an iron alloy or steel.

14. The article of claim 1 where a layer of flexible compressible material is interposed between said article and said sheet of sinterable particulate metal and binder.

15. The article of claim 2 where a layer of flexible compressible material is interposed between said article and said sheet of sinterable particulate metal and binder.

16. The article of claim 6 where a layer of flexible compressible material is interposed between said article and said sheet of sinterable particulate metal and binder.

17. The article of claim 9 where a layer of flexible compressible material is interposed between said article and said sheet of sinterable particulate metal and binder.

18. The article of claim 14 where said layer of flexible compressible material is selected from metal fiber or ceramic fiber meshes and/or mats.

19. The article of claim 18 where said layer is steel wool.

20. The article of claim 15 where said layer of flexible compressible material is selected from metal fiber or ceramic fiber meshes and/or mats.

21. The article of claim 20 where said layer is steel wool.

22. The article of claim 16 where said layer of flexible compressible material is selected from metal fiber or ceramic fiber meshes and/or mats.

23. The article of claim 22 where said layer is steel wool.

24. The article of claim 17 where said layer of flexible compressible material is selected from metal fiber or ceramic fiber meshes and/or mats.

25. The article of claim 24 where said layer is steel wool.

26. A method of encasing an object in metal comprising (a) wrapping said object in a sheet sinterable particulate or powdered metal and a binder, and (b) firing the resulting wrapped object into a unitary metal structure.

27. The method of claim 26 where said object is formed from a sinterable particulate material.

28. The method of claim 27 where said sinterable particulate material is selected from the group consisting of glasses, ceramics, glass-ceramics, cermets and metal powders.

29. The method of claim 27 where said object is in the green form prior to the firing of said sheet of sinterable particulate or powdered metal admixed with organic binder.

30. The method of claim 27 where said object is sintered prior to the firing of said sheet of sinterable particulate or powdered metal admixed with organic binder.

31. The method of claim 28 where said object is a ceramic monolithic substrate.

32. The method of claim 31 where said ceramic monolithic substrate is in the green form prior to the firing of said sheet of sinterable particulate or powdered metal admixed with organic binder.

33. The method of claim 28 where said object is a honeycomb monolith.

34. The method of claim 33 where said honeycomb monolith is in the green form prior to the firing of said sheet of sinterable particulate or powdered metal admixed with organic binder.

35. The method of claim 26 where said sheet of sinterable particulate metal is a tape cast sheet.

36. The method of claim 35 where said sheet is tape cast from a slurry of particulate metal, binder and volatile organic solvent comprising about 60 to 80 % by weight solids.

37. The method of claim 26 where said sheet of sinterable particulate metal is an extruded sheet.

38. The method of claim 26 where said particulate metal is an iron alloy or steel.

39. The method of claim 26 where a layer of flexible compressible material is interposed between said article and said sheet of sinterable particulate metal and binder.

40. The method of claim 39 where said layer of flexible compressible material is selected from metal fiber or ceramic fiber meshes and/or mats.

41. The method of claim 40 where said layer is steel wool.

42. The method of claim 26 where said article is fired at a temperature of about 1000° to 1300° C.

* * * * *